United States Patent [19]

Iytaka et al.

[11] 4,268,620

[45] May 19, 1981

[54] METHOD OF PROCESSING OF LIGHT-SENSITIVE SILVER HALIDE PHOTOGRAPHIC MATERIAL

[75] Inventors: Tateshi Iytaka; Syunji Matsuo; Toshio Nagatani; Kazuo Takahashi; Takeshi Habu, all of Hino, Japan

[73] Assignee: Konishiroku Photo Industry Co., Ltd., Tokyo, Japan

[21] Appl. No.: 869,658

[22] Filed: Jan. 16, 1978

[30] Foreign Application Priority Data

Jan. 31, 1977 [JP] Japan ..... 52-9337

[51] Int. Cl.[2] ..... G03C 5/30

[52] U.S. Cl. ..... 430/403; 430/436; 430/264; 430/949; 430/600; 430/570

[58] Field of Search ..... 96/95, 107, 109, 54, 96/66 HD

[56] References Cited

U.S. PATENT DOCUMENTS

| | | | |
|---|---|---|---|
| T887,016 | 6/1971 | Milton | 96/107 |
| 3,071,465 | 1/1963 | Dersch | 96/109 |
| 3,420,664 | 1/1969 | Dersch | 96/109 |
| 3,592,656 | 7/1971 | Brooks | 96/109 |
| 3,597,213 | 8/1971 | Dersch | 96/109 |
| 3,671,244 | 6/1972 | Bissonette | 96/54 |
| 3,847,618 | 11/1974 | Hofman | 96/66.3 |
| 3,909,268 | 9/1975 | Baldassarri | 96/109 |
| 3,942,985 | 3/1976 | Newman | 96/66.3 |
| 3,955,983 | 5/1976 | Nakajima | 96/66.3 |

FOREIGN PATENT DOCUMENTS

| | | | |
|---|---|---|---|
| 2634616 | 2/1977 | Fed. Rep. of Germany | 96/95 |

OTHER PUBLICATIONS

Making & Coating Emulsions, Zelikman & Levi, 1965, p. 13.

*Primary Examiner*—Mary F. Downey

*Attorney, Agent, or Firm*—Frishauf, Holtz, Goodman & Woodward

[57] ABSTRACT

A light-sensitive silver halide photographic material containing a tetrazolium compound, is treated with a developing solution containing no hydroquinone developing agent, which material comprises a support and a silver halide emulsion layer coated thereon, containing silver halide grains having an average grain size of 0.05 to 1.5μ, at least 75% of said grains being within a range of 0.6 to 1.4 times the said average grain size and a sensitizing dye.

10 Claims, No Drawings

METHOD OF PROCESSING OF LIGHT-SENSITIVE SILVER HALIDE PHOTOGRAPHIC MATERIAL

The present invention relates to a novel process for processing light-sensitive silver halide photographic material. Particularly, it relates to a novel process for developing lith type light-sensitive silver halide photographic material for obtaining a photographic image with an especially high contrast, high sharpness and high resolving power.

More particularly, it relates to a novel processing of a light-sensitive silver halide photographic material which is applicable advantageously to a light-sensitive silver halide photographic material with a high contrast suitable for forming a dot- or line-image on a lith (printing) light-sensitive material or a copying silver halide light-sensitive material.

It has been known to form a photographic image with extremely high contrast by using some kind of a light-sensitive silver halide photographic material.

It has been known, for example, to obtain a high contrast image, e.g. a line- or dot-image by treating, with an alkaline hydroquinone developing solution containing sulfite ions in a very low concentration, a light-sensitive material which comprises a silver chlorobromide emulsion containing silver chloride in a high content (at least more than 50 mole %) the grains of the emulsion being minute (average grain size; ca. 0.2$\mu$), uniform in size and shape, and the grain size distribution thereof being narrow. The above-mentioned kind of light-sensitive silver halide material is known as the lith type light-sensitive material.

In printing, there is usually required such a process as to convert a continuous gradation original image to a dot image; that is a process to convert the densities of the continuous gradation to a predetermined numbered assembly of dots respectively having areas of the same densities but proportional in size to the densities of the continuous gradation. In order to carry out this, the lith type light-sensitive material is subjected to development, after photographing the original image through a cross- or contact-screen, to form the dot image on the light-sensitive material.

For this purpose there has been employed a light-sensitive silver halide photographic material containing a silver halide emulsion, the grains of which being minute and uniform in size and shape. Even when this kind of a light-sensitive silver halide photographic material is employed, the intermediate density region (undesirable continuous gradation parts) is reproduced, beside the maximum density region and the minimum one (fog), when the material is processed with a standard black-and-white developing solution. The intermediate density region becomes the so-called fringe, undesirable for producing a printing plate and making the dot quality worse.

There has heretofore been employed the lith type light-sensitive material also for the reproduction of a line image. For the same reason, however, there have been obtained images having at best the $\gamma$-value of 5–6 of the characteristic curve, which is lower than the 7–9 required for forming the desirable line-image, if the standard black-and-white developing solution is employed. In order to avoid this, there has been employed, as mentioned above, a specific developing solution called "an infectious developing solution" or "lith type developing solution".

The infectious or lith type developing solution is referred to as a developing solution in which hydroquinone is substantially the sole developing agent and the concentration of sulfite ion is low, as described detailedly in J. A. C. Yule, J. Franklin Inst., 239, 221 (1945).

As is deduced from the composition, lith type developing solution is poor in storability and subject to autoxidation. It is therefore unavoidable that the control system of a trader concerned in photo-mechanical processing for obtaining a halftone negative/positive of high quality becomes complicated.

As it is extremely advantageous to improve the storability of lith type developing solution, every effort has been made therefor. However, there has been known no method capable of obtaining a dot image with a good dot quality, by using a developing solution which can compare in storability with such a developing solution for continuous gradation as Metol/hydroquinone or phenidone/hydroquinone developing solution, e.g., Sakura dol type 311, type 411, type 431, etc. (Sakura dol is a registered trademark.).

It is, therefore, the primary object of the invention to provide the processing of a novel light-sensitive silver halide photographic material to obtain a high contrast silver image.

It is another object of the invention to provide a novel process using a lith type light-sensitive silver halide material containing a tetrazolium compound, which material is dye-sensitized, shows an excellent stability during development, and is suitable for obtaining a dot- or line-image.

It is still another object of the invention to provide a novel processing method of the above-mentioned lith type light-sensitive silver halide material to obtain a high contrast black-and-white silver image, especially a dot- or line-image.

A further object of this invention is to provide a novel light-sensitive silver halide photographic material which is treated with a developing solution of good storability, namely, a developing solution not containing hydroquinone developing agent.

A still further object of this invention is to provide a novel processing method of a light-sensitive silver halide photographic material using a developing solution of good storability, namely, a developing solution not containing hydroquinone developing agent.

The above-mentioned objects of this invention and other objects mentioned hereinafter can be attained by using a light-sensitive silver halide photographic material containing a tetrazolium compound in which a silver halide emulsion layer is coated on a support and which is treated with a developing solution containing no hydroquinone developing agent, the silver halide emulsion layer containing silver halide grains having an average grain size of 0.05 to 1.5$\mu$, at least 75% of which grains being within a range of 0.6 to 1.4 times the average grain size and a sensitizing dye in the silver halide emulsion layer; and by processing said light-sensitive silver halide photographic material, after imagewise exposure, with a developing solution containing no hydroquinone developing agent.

According to a preferred embodiment of the invention, there is obtained a high contrast silver image with a development stability and a superior reproducibility of the line image by processing a light-sensitive silver halide photographic material containing silver halide grains having the above-mentioned grain size and the distribution thereof (hereinafter referred to as the silver halide of the invention), a diffusible tetrazolium compound and a sensitizing dye, after the imagewise exposure, with a developing solution containing no hydroquinones developing agent.

According to another preferred embodiment of the invention, there is obtained a dot-image (halftone image) with a superior dot quality by developing a light-sensitive silver halide photographic material containing the silver halide of the invention and a non-diffusible tetrazolium compound, after imagewise exposure through a contact screen, with a developing solution containing one or more developing agents, e.g., phenidone-Metol developing solution, Metol plain developing solution, phenidone-ascorbic acid developing solution, p-phenylenediamine-Metol developing solution, etc.

The developing solution used in the processing method to which this invention relates, is a developing solution containing no hydroquinone as a developing agent. As will be mentioned detailedly hereinafter, the developing solution which is used in the invention (hereinafter referred to as the developing solution of the invention) is a developing solution containing at least one developing agent excluding a hydroquinone developing agent such as Metol, phenidone, p-aminophenol, ascorbic acid, etc.

In the invention, there may be added, for other purposes, a hydroquinone developing agent in extremely small amounts which do not impair the effect of the invention, to the developing solution of the invention.

It can not be expected from heretofore known techniques that the high contrast line- or dot-image could be obtained without employing the infectious developing solution.

The term "non-diffusible tetrazolium compound" in the invention means a compound which does not dissolve from the light-sensitive material to the developing solution during the development. In other words, the compound does not dissolve in a concentration of several %, preferably not more than 2%, when a gelatin layer containing the compound is dipped for 10 minutes in an aqueous solution at 20°–40° C. having the same ion strength and pH-value as those of the developing solution.

The representative tetrazolium compounds employed in the invention include the following compounds represented by the general formulae:

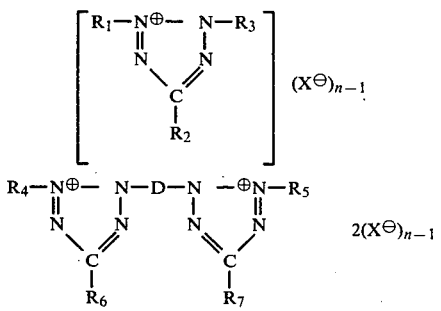

(I)

(II)

-continued

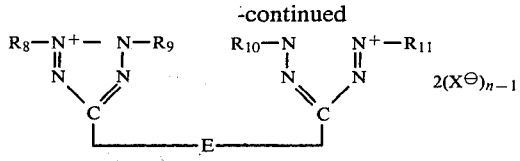

(III)

In the above formulae, $R_1$, $R_3$, $R_4$, $R_5$, $R_8$, $R_9$, $R_{10}$ and $R_{11}$ each represent a group selected from an alkyl group (e.g., methyl, ethyl, propyl, dodecyl, etc.), an alkenyl group such as an allyl group, an aryl group such as a phenyl group (e.g., phenyl, tolyl, chlorophenyl, bromophenyl, iodophenyl, hydroxyphenyl, carboxyphenyl, aminophenyl, nitrophenyl or mercaptophenyl, etc.), a naphthyl group (e.g., α-naphthyl, β-napthyl, hydroxynaphthyl, carboxynaphthyl or aminonaphthyl, etc.) and a heterocyclic group (e.g., thiazolyl group, benzothiazolyl group, oxazolyl group, pyrimidinyl group or pyridyl group, etc.), and each group may be a group capable of forming a metal chelate or a complex; $R_2$, $R_6$ and $R_7$ each represent an alkenyl group such as allyl, a phenyl group and a naphthyl group, a heterocyclic group, an alkyl group (e.g., methyl, ethyl, propyl, butyl, mercaptomethyl or mercaptoethyl, etc.), a hydroxyl group, a carboxyl group or the salt thereof, an alkoxycarbonyl group (e.g., methoxycarbonyl, ethoxycarbonyl, etc.), an amino group (e.g. amino, ethylamino or anilino, etc.), a mercapto group such as -SR' [R' is a hydrogen, an alkyl group (e.g. methyl, ethyl, etc.) or an aryl group (e.g. the aryl group as illustrated in $R_1$)] nitro and hydrogen; D represents an arylene group such as a phenylene and naphtylene; E represents a group selected from an alkylene group, an arylene group and an aralkylene group; $X^{\ominus}$ represents an anion [e.g. a halide ion (e.g. chloride ion, bromide ion etc); a perchlorate ion etc.]; and n is 1 or 2, provided that the compound forms an intramolecular salt when n is 1.

The cation moiety of the tetrazolium compounds used in the invention will be shown below but they are not intended to limit the moiety capable of being used in the invention.

(1) 2,3,5-Triphenyl-2H-tetrazolium
(2) 2,3,5-Tri(p-carboxyethylphenyl)-2H-tetrazolium
(3) 2-(Benzothiazol-2-yl)-3-phenyl-5-(o-chlorophenyl)-2H-tetrazolium
(4) 2,3-Diphenyl-2H-tetrazolium
(5) 2,3-Diphenyl-5-methyl-2H-tetrazolium
(6) 3-(p-Hydroxyphenyl)-5-methyl-2-phenyl-2H-tetrazolium
(7) 2,3-Diphenyl-5-ethyl-2H-tetrazolium
(8) 2,3-Diphenyl-5-n-hexyl-2H-tetrazolium
(9) 5-Cyano-2,3-diphenyl-2H-tetrazolium
(10) 2-(Benzothiazol-2-yl)-5-phenyl-3-(4-tolyl)-2H-tetrazolium
(11) 2-(Benzothiazol-2-yl)-5-(4-chlorophenyl)-3-(4-nitrophenyl)-2H-tetrazolium
(12) 5-Ethoxycarbonyl-2,3-di(3-nitrophenyl)-2H-tetrazolium
(13) 5-Acetyl-2,3-di(p-ethoxyphenyl)-2H-tetrazolium
(14) 2,5-Diphenyl-3-(p-tolyl)-2H-tetrazolium
(15) 2,5-Diphenyl-3-(p-iodophenyl)-2H-tetrazolium
(16) 2,3-Diphenyl-5-(p-diphenyl)-2H-tetrazolium
(17) 5-(p-Bromophenyl)-2-phenyl-3-(2,4,6-trichlorophenyl)-2H-tetrazolium
(18) 3-(p-Hydroxyphenyl)-5-(p-nitrophenyl)-2-phenyl-2H-tetrazolium

(19) 5-(3,4-Dimethoxyphenyl)-3-(2-ethoxyphenyl)-2-(4-methoxyphenyl)-2H-tetrazolium
(20) 5-(4-Cyanophenyl)-2,3-diphenyl-2H-tetrazolium
(21) 3-(p-Acetamidophenyl)-2,5-diphenyl-2H-tetrazolium
(22) 5-Acetyl-2,3-diphenyl-2H-tetrazolium
(23) 5-(Fur-2-yl)-2,3-diphenyl-2H-tetrazolium
(24) 5-(Thien-2-yl)-2,3-diphenyl-2H-tetrazolium
(25) 2,3-Diphenyl-5-(pyrid-4-yl)-2H-tetrazolium
(26) 2,3-Diphenyl-5-(quinol-2-yl)-2H-tetrazolium
(27) 2,3-Diphenyl-5-(benzoxazol-2-yl)-2H-tetrazolium
(28) 2,3-Diphenyl-5-nitro-2H-tetrazolium
(29) 2,2',3,3'-Tetraphenyl-5,5'-1,4-butylene-di(2H-tetrazolium)
(30) 2,2',3,3'-Tetraphenyl-5,5'-p-phenylene-di(2H-tetrazoloum)
(31) 2-(4,5-Dimethylthiazol-2-yl)-3,5-diphenyl-2H-tetrazolium
(32) 3,5-Diphenyl-2-(triazin-2-yl)-2H-tetrazolium
(33) 2-(Benzothiazol-2-yl)-3-(4-methoxyphenyl)-5-phenyl-2H-tetrazolium
(34) 2-p-Iodophenyl-3-nitrophenyl-5-phenyl-2H-tetrazolium In cases where the tetrazolium compounds used in the invention are used in a non-diffusible form, a non-diffusible compound obtained by reacting a diffusible compound in the above-exemplified compounds with an anion is used.

Preferably said anion is a surfactant having at least 9 carbon atoms, being represented by the general formulas [IV], [V], [VI], [VII] and [VIII].

Formula [IV]

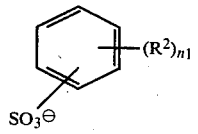

wherein $R^2$ represents an alkyl group including alkyl and substituted alkyl. $n_1$ is an integer of 1 to 3.

For example:
4-iso-propyl-benzene-sulfonate
2,3,5-triethyl-benzene-sulfonate
4-dodecyl-benzene-sulfonate
4-(2-fluoro)-hexyl-benzene-sulfonate Formula [V]

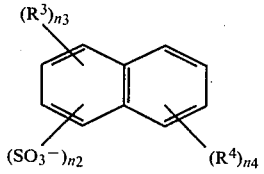

wherein $R^3$ and $R^4$ individually represent hydrogen, an alkyl group including alkyl and substituted alkyl, $n_2$, $n_3$ and $n_4$ are an integer of 1 to 3.

For example:
1,5-di-iso-propylnaphthalene-4-sulfonate
2,6-di-tert-amylnaphthalene-4-sulfonate
1,5-di-iso-propylnaphthalene-4,8-di-sulfonate
2,4-di-methyl-6-n-propylnaphthalene-8-sulfonate
1,5-di-(2-chloropentyl)-naphthalene-4-sulfonate Formula [IV]

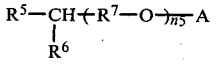

wherein $R^5$ and $R^6$ individually represent hydrogen, an alkyl group including alkyl and substituted alkyl, $R^7$ represents ethylene group including ethylene and substituted ethylene and propylene group including propylene and substituted propylene, $n_5$ is an integer (preferably 10 to 100), A represents $—SO_3^{\ominus}$ and $—COO^{\ominus}$.

For example:

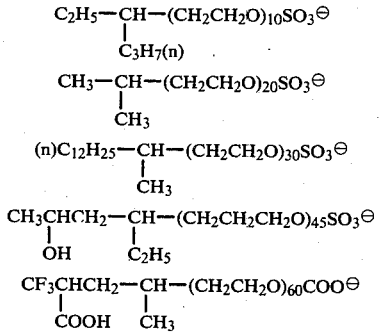

Formula [VII]

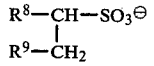

wherein $R^8$ represents hydrogen, an alkyl group including alkyl and substituted alkyl and an alkyloxycarbonyl group including alkyloxycarbonyl and substituted alkyloxycarbonyl group; $R^9$ represents an alkyl group including alkyl and substituted alkyl and an alkyloxycarbonyl group including alkyloxycarbonyl and substituted alkyloxycarbonyl.

For example:
$(n)C_{12}H_{25}SO_3^{\ominus}$

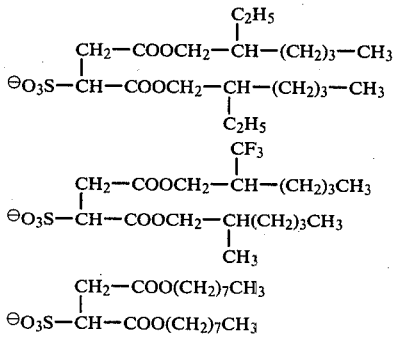

Formula [VIII]

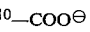

wherein $R^{10}$ represents a saturated or an unsaturated alkyl group including alkyl and substituted alkyl.

For example:
$n\text{-}C_{11}H_{23}COO^{\ominus}$
$n\text{-}C_{17}H_{35}COO^{\ominus}$
$CH_3(CH_2)_7CH{=}CH(CH_2)_7COO^{\ominus}$ The non-diffusible tetrazolium compounds according to the invention are thus synthesized by an optional selection of the anionic and cationic moieties. The non-diffusible compounds, e.g. 2,3,5-triphenyl-2H-tetrazolium dioctyl-succinate-sulfonate may be dispersed into a gelatin solution by mixing the respective soluble tetrazolium salt and anion with the gelatin to disperse them in the gelatin matrix to obtain the gelatin solution dispersed with the non-diffusible, tetrazolium compound as specifically mentioned in working Examples set forth later.

Alternatively, crystals of the non-diffusible tetrazolium compound may be dissolved in a suitable solvent such as dimethylsulfoxide and then dispersed in the gelatin solution.

When the dispersion is not sufficiently homogeneous, good results may be obtained by exposing the emulsion dispersion to an ultrasonic wave or by use of a suitable homogenizer such as Manton-Gaulin homogenizer.

The following are typical examples of the salts of tetrazolium which may be used in this invention but not intended to limit the salts of tetrazolium compound employable in this invention.

(1) 2-(Benzothiazol-2-yl)-3-phenyl-5-dodecyl-2H-tetrazolium bromide
(2) 2,3-Diphenyl-5-(4-t-octyloxyphenyl)-2H-tetrazolium chloride
(3) 2,3,5-Triphenyl-2H-tetrazolium chloride
(4) 2,3,5-Tri(p-carboxyethylphenyl)-2H-tetrazolium chloride
(5) 2-(Benzothiazol-2-yl)-3-phenyl-5-(o-chlorophenyl)-2H-tetrazolium bromide
(6) 2,3-Diphenyl-2H-tetrazolium chloride
(7) 2,3-Diphenyl-5-methyl-2H-tetrazolium chloride
(8) 3-(p-Hydroxyphenyl)-5-methyl-2-phenyl-2H-tetrazolium bromide
(9) 2,3-Diphenyl-5-ethyl-2H-tetrazolium bromide
(10) 2,3- Diphenyl-5-n-hexyl-2H-tetrazolium bromide
(11) 5-Cyano-2,3-diphenyl-2H-tetrazolium bromide
(12) 2-(Benzothiazol-2-yl)-5-phenyl-3-(4-tolyl)-2H-tetrazolium bromide
(13) 2-(Benzothiazol-2-yl)-5-(4-chlorophenyl)-3-(4-nitrophenyl)-2H-tetrazolium chloride
(14) 5-Ethoxycarbonyl-2,3-di(3-nitrophenyl)-2H-tetrazolium chloride
(15) 5-Acetyl-2,3-di(p-ethoxyphenyl)-2H-tetrazolium bromide
(16) 2,5-Diphenyl-3-(p-tolyl)-2H-tetrazolium chloride
(17) 2,5-Diphenyl-3-(p-iodophenyl)-2H-tetrazolium chloride
(18) 2,3-Diphenyl-5-(p-diphenyl)-2H-tetrazolium chloride
(19) 5-(p-Bromophenyl)-2-phenyl-3-(2,4,6-trichlorophenyl)-2H-tetrazolium chooride
(20) 3-(p-Hydroxyphenyl)-5-(p-nitrophenyl)-2-phenyl-2H-tetrazolium chloride
(21) 5-(3,4-Dimethoxyphenyl)-3-(2-ethoxyphenyl)-2-(4-methoxyphenyl)-2H-tetrazolium chloride
(22) 5-(4-Cyanophenyl)-2,3-diphenyl-2H-tetrazolium chloride
(23) 3-Acetamidophenyl)-2,5-diphenyl-2H-tetrazolium bromide
(24) 5-Acetyl-2,3-diphenyl-2H-tetrazolium bromide
(25) 5-(Fur-2-yl)-2,3-diphenyl-2H-tetrazolium chloride
(26) 5-(Thien-2-yl)-2,3-diphenyl-2H-tetrazolium chloride
(27) 2,3-Diphenyl-5-(pyrid-4-yl)-2H-tetrazolium chloride
(28) 2,3-Diphenyl-5-(quinol-2-yl)-2H-tetrazolium bromide
(29) 2,3-Diphenyl-5-(benzoxazol-2-yl)-2H-tetrazolium bromide
(30) 2,3-Diphenyl-5-nitro-2H-tetrazolium bromide
(31) 2,2',3,3'-Tetraphenyl-5,5'-1,4-butylene-di-(2H-tetrazolium) bromide
(32) 2,2',3,3'-Tetraphenyl-5,5'-p-phenylene-di-(2H-tetrazolium) bromide
(33) 2-(4,5-Dimethylthiazol-2-yl)-3,5-diphenyl-2H-tetrazolium bromide
(34) 3,5-Diphenyl-2-(triazin-2-yl)-2H-tetrazolium chloride
(35) 2-(Benzothiazol-2-yl)-3-(4-methoxyphenyl)-5-phenyl-2H-tetrazolium bromide
(36) 2-p-Iodophenyl-3-p-nitrophenyl-5-phenyl-2H-tetrazolium chloride
(37) 2-(Benzothiazol-2-yl)-3-phenyl-5-dodecyl-2H-tetrazolium stearate
(38) 2,3-Diphenyl-5-(4-t-octyloxyphenyl)-2H-tetrazolium laurate
(39) 2,3,5-Triphenyl-2H-tetrazolium di-2-ethylhexylsulfosuccinate
(40) 2,3,5-Tri(p-carboxyethylphenyl)-2H-tetrazolium stearate
(41) 2-(Benzothiazol-2-yl)-3-phenyl-5-(o-chlorophenyl)-lauryl 2H-tetrazolium p-dodecylbenzenesulfonate
(42) 2,3-Diphenyl-2H-tetrazolium di-2-ethylhexylsulfosuccinate
(43(2,3-Diphenyl-5-methyl-2H-tetrazolium p-octylbenzenesulfonate
(44) 3-(p-Hydroxyphenyl)-5-methyl-2-phenyl-2H-tetrazoliumstearate
(45) 2,3-Diphenyl-5-ethyl-2H-tetrazolium di-3-methylnonylsulfonate
(46) 2,3-Diphenyl-5-n-hexyl-2H-tetrazolium p-octadecylbenzenesulfonate
(47) 5-Cyano-2,3-diphenyl-2H-tetrazolium di-2-ethylhexylsulfosuccinate
(48) 2-(Benzothiazol-2-yl)-5-phenyl-3-(4-tolyl)-2H-tetrazolium p-dodecylbenzenesulfonate
(49) 2-(Benzothiazol-2-yl)-5-(4-chlorophenyl)-3-(4-nitrophenyl)-2H-tetrazolium di-isopropylnaphtalensulfonate
(50) 5-Ethoxycarbonyl-2,3-di(3-nitrophenyl)-2H-tetrazolium stearate
(51) 5-Acetyl-2,3-di(p-ethoxyphenyl)-2H-tetrazolium laurate
(52) 2,5-Diphenyl-3-(p-tolyl)-2H-tetrazoliums stearate
(53) 2,5-Diphenyl-3-(p-iodophenyl)-2H-tetrazolium laurate
(54) 2,3-Diphenyl-5-(p-diphenyl)-2H-tetrazolium di-isopropylnaphtalenesulfonate
(55) 5-(p-Bromophenyl)-2-phenyl-3-(2,4,6-trichlorophenyl)-2H-tetrazolium di-isopropylnaphtalene-disulfonate
(56) 3-(p-Hydroxyphenyl)-5-(p-nitrophenyl)-2-phenyl-2H-tetrazolium p-dodecylbenzonesulfonate
(57) 5-(3,4-Dimethoxyphenyl)-3-(2-ethoxyphenyl)-2-(4-methoxyphenyl)-2H-tetrazolium di-2-ethylhexylsulfosuccinate
(58) 5-(4-Cyanophenyl)-2,3-diphenyl-2H-tetrazolium laurate
(59) 3-(p-Acetamidophenyl)-2,5-diphenyl-2H-tetrazolium stearate
(60) 5-Acetyl-2,3-diphenyl-2H-tetrazolium p-octadecylbenzenesulfonate

(61) 5-(Fur-2-yl)-2,3-diphenyl-2H-tetrazolium di-2-ethylhexylsulfonate

(62) 5-(Thien-2-yl)-2,3-diphenyl-2H-tetrazolium stearate

(63) 2,3-Diphenyl-5-(pyrid-4-yl)-2H-tetrazolium laurate

(64) 2,3-Diphenyl-5-(quinol-2-yl)-2H-tetrazolium stearate

(65) 2,3-Diphenyl-5-(benzoxazol-2-yl)-2H-tetrazolium laurate

(66) 2,3-Diphenyl-5-nitro-2H-tetrazolium di-isopropyl-naphtalenesulfonate

(67) 2,2',3,3'-Tetraphenyl-5,5'-1,4-butylene-di-(2H-tetrazolium) di-3-propyl-nonylsulfonate

(68) 2,2',3,3'-Tetraphenyl-5,5'-p-phenylene-di-(2H-tetrazolium) p-dodecylbenzenesulfonate

(69) 2-(4,5-Dimethylthiazol-2-yl)-3,5-diphenyl-2H-tetrazolium stearate

(70) 3,5-Diphenyl-2-(triazin-2-yl)-2H-tetrazolium laurate

(71) 2-Benzothiazol-2-yl)-3-(4-methoxyphenyl)-5-phenyl-2H-tetrazolium p-tolylsulfonate

(72) 2-p-Iodophenyl-3-p-nitrophenyl-5-phenyl-2H-tetrazolium di-isopropylnaphtalene-di-sulfonate

(73) 2,3,5-Triphenyl-2H-tetrazolium di-iso-propylnaphtalene-di-sulfonate

As mentioned above, the tetrazolium compounds of this invention may be used both in diffusible and non-diffusible forms, when the silver halide in this invention is employed. However, the higher contrast image may be obtained by employing the non-diffusible tetrazolium compounds. Accordingly, it is advantageous to employ the non-diffusible tetrazolium compound when an especially superior dot quality is required.

On the other hand, the use of too much high contrast light-sensitive material sometimes brings about insufficient reproduction of the line-image, particularly those of fine letters and lines. In this case, an image with more superior quality may be obtained by the use of the diffusible tetrazolium compounds.

Among the diffusible or non-diffusible tetrazolium compounds used in the invention, a 2,3,5-triphenyl-2H-tetrazolium group compound may desirably be used in the invention.

Among the non-diffusible tetrazolium compounds employed in the invention, the compound obtained from 2,3,5-triphenyl-2H-tetrazolium and diisopropylnaphthalenedisulfonic acid, the compound obtained from 2,3,5-triphenyl-2H-tetrazolium and diethylhexylsuccinate disulfonic acid and the compound obtained from 2-p-iodophenyl-3-p-nitrophenyl-5-phenyl-2H-tetrazolium and diethylhexylsuccinate disulfonic acid may preferably be used in the invention.

As mentioned above, advantages such as that the development latitude is broaden in the invention by using preferred compounds in combination, and these compounds may be used in optional combination in accordance with the purpose.

The tetrazolium compound of the invention preferably is incorporated into a silver halide emulsion layer containing the silver halide of this invention.

More specifically, the compound is incorporated in the silver halide emulsion layer and/or in a layer adjacent directly or indirectly to the layer containing the silver halide emulsion.

That is, for example, the tetrazolium compound of the invention may be incorporated in the light-sensitive silver halide photographic material of the invention by dissolving it in a suitable solvent and coating, by an over-coat method, etc., directly on the outermost part of the photographic material or the outermost part of the photographic material on preparation.

The above-mentioned tetrazolium compounds of the invention may preferably be employed in an amount of 0.0001–10 moles, more preferably 0.001–1 mole, per mole of the silver halide contained in the light-sensitive silver halide photographic material of the invention.

The sensitizing dyes used in this invention mean those which can extend a sensitive wave length range of the silver halide outside of its inherent sensitive wave length. Sensitizing dyes used for this invention cover those such as cyanines, merocyanines, hemicyanines, oxonols, hemioxonols or mixed merocyanines. Such dyes are described in e.g. "The cyanine dye and related compounds" by F. M. Hamer and "The Theory of Photographic Process", Third edition page 198–280, by C. E. Kenneth Mees and T. H. James, Preferred sensitizing dyes of this invention may be concretely expressed by the general formulae [IV]–[X];

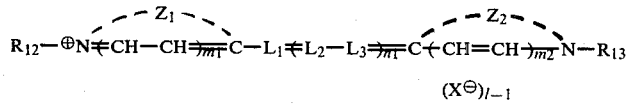

[IV]

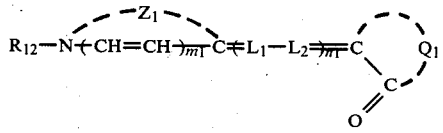

[V]

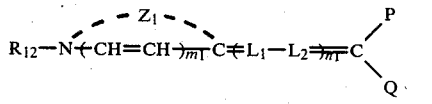

[VI]

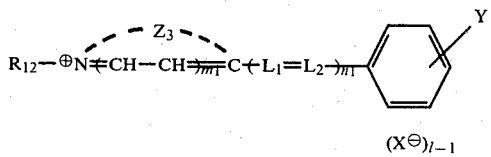

[VII]

-continued

[VIII]

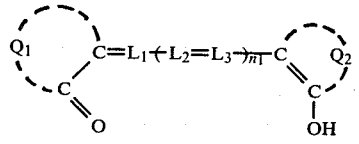

[IX]

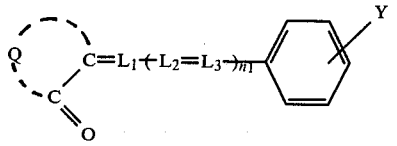

[X]

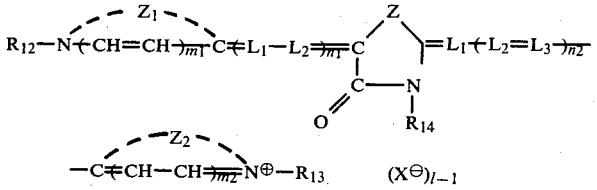

In which $R_{12}$, $R_{13}$ and $R_{14}$ each represent a group selected from an alkyl group (e.g. methyl, ethyl, propyl, pentyl, etc.), a substituted alkyl (e.g. chloroethyl, hydroxyethyl, methoxyethyl, acetoxyethyl, carboxymethyl, carboxyethyl, ethoxycarbonylmethyl, sulfoethyl, sulfopropyl, sulfobutyl, β-hydroxy-γ-sulfopropyl, sulfatepropyl, allyl, benzyl, phenethyl, etc.), an aryl group (e.g. phenyl) and a substituted phenyl group (e.g. carboxyphenyl, sulfophenyl, etc.); $L_1$, $L_2$ and $L_3$ each represent a methynyl group including a substituted methynyl (e.g. —CH=, —C($CH_3$)=, —C($C_2H_5$)=, —C($CH_2COOH$)=,

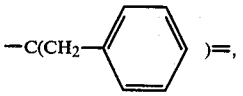

—C($C_6H_5$)=, —C($C_6H_4COOH$)=, etc.); $Z_1$, $Z_2$ and $Z_3$ each represent an atom or an atom group necessary for forming a substituted or unsubstituted 5 to 6 membered heterocyclic ring, for example, a thiazoline nucleus (e.g. thiazoline, 4-methylthiazoline, 4-phenylthiazoline, etc.), an oxazoline nucleus (e.g. oxazoline, 4-methyloxazoline, etc.), a selenazoline nucleus (e.g. selenazoline, 4-methylselenazoline, etc.), a thiazole nucleus (e.g. thiazole, 4-methylthiazole, 4-phenylthiazole, 5-methylthiazole, 4,5-dimethylthiazole, 4,5-diphenylthiazole, etc.), a selenazole nucleus (e.g. selenazole, 4-methylselenazole, etc.), an oxazole nucleus (e.g. oxazole, 4-methyloxazole, 4,5-dimethyloxazole, 5-ethyloxazole, 5-phenyloxazole, etc.), a benzothiazole nucleus (e.g. benzothiazole, 4-chlorobenzothaizole, 5-methylbenzothiazole, 6-methoxybenzothiazole, 5,6-dimethoxybenzothiazole, 6-sulfobenzothiazole, etc.), a benzoxazole nucleus (e.g. benzoxazole, 5-chlorobenzoxazole, 6-methylbenzoxazole, 5-hydroxybenzoxazole, 4,5-dimethylbenzoxazole, etc.), a benzoselenazole nucleus (e.g. benzoselenazole, 5-chlorobenzoselenazole, 5-methoxybenzoselenazole, 5-hydroxybenzoselenazole, tetrahydrobenzoselenasole, etc.), a benzimidazole nucleus (e.g. benzimidazole, 3-ethylbenzimidazole, 1-phenyl-5,6-dichlorobenzimidazole, etc.), an indolenine nucleus (e.g. 3,3-dimethylindolenine, 3,3-diethylindolenine, 3,3,7-trimethylindolenine, etc.), a naphthothiazole nucleus (e.g. naphtho[2,1-d]thiazole, naphtho[1,2-d]thiazole, 5-methoxynaphtho[2,3-d]thiazole, etc.), a naphthoxazole nucleus (e.g. naphtho[2,1-d]oxazole, naphtho[1,2-d]oxazole, etc.), a naphthoselenazole nucleus (e.g. naphtho[2,1-d]selenazole, naphtho[1,2-d]selenazole, etc.), a thienothaizole nucleus, a pyridine nucleus (e.g. 2-pyridine, 5-methyl-2-pyridine, 4-pyridine, 3-methyl-4-pyridine, etc.) and quinoline nucleus (e.g. 2-quinoline, 3-methyl-2-quinoline, 6-chloro-2-quinoline, 8-hydroxy-2-quinoline, 4-quinoline, 6-methoxy-4-quinoline, 1-isoquinoline, 3,4-dihydro-1-isoquinoline, 3-isoquinoline, etc.); P and Q each represent cyano, —$COOR_{15}$, —$COR_{15}$ or —$SO_2R_{15}$ in which $R_{15}$ represents an alkyl group; further $Q_1$ and $Q_2$ each represent an atomic group necessary for forming a thiooxazolone ring, a pyrazolone ring, an oxyindole ring, a bardituric acid, a 2-thiobarbituric acid, 2,4-oxazolidinedione ring, a 2,4-thiazolidinedione ring, a 2,4-imidazolidinedione ring, a 2-thio-2,4-oxazolidinedione ring, a 2-thio-2,4-thiazolidinedione ring, a 2-thio-2,4-selenazolidinedione ring, a 2-thio-2,5-thiazolidinedione ring, a 2-thiohydantoine ring, a 4-oxazolinone ring, a 4-thiazolinone ring or a 4-imidazoline ring, etc., the groups or rings including the substituted; Y represents hydrogen, amino, alkylamino preferably having 1 to 4 carbon atoms (e.g. ethylamine, etc.), dialkylamino preferably having 2 to 8 carbon atoms (e.g. dimethylamino, etc.), halogen (e.g. chlorine or bromine atom, etc.) or an alkyl group preferably having 1 to 4 carbon atoms (e.g. methyl, etc.); $m_1$ and $m_2$ each represent zero or 1; $n_1$ and $n_2$ each represent 0 or 2; X represents an acid anion (e.g. $Cl^{\ominus}$, $Br^{\ominus}$, $I^{\ominus}$, $ClO_4^{\ominus}$,

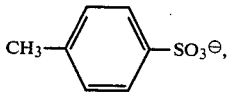

$CH_3SO_4^{\ominus}$, $C_2H_5SO_4^{\ominus}$, etc.); l represents 1 or 2 and an intramolecular salt is formed when l represents 1.

Typical sensitizing dyes having the above general formulae according to this invention will be exemplified below but this is not intended to limit these dyes:

1.

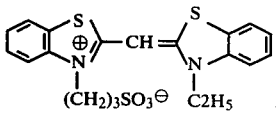

-continued
2.
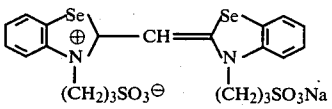
3.
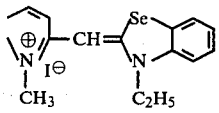
4.
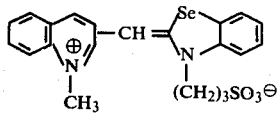
5.
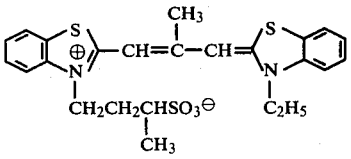
6.
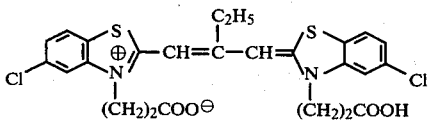
7.
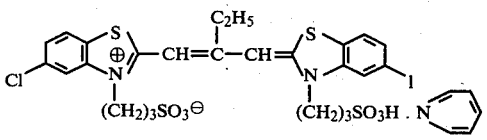
8.
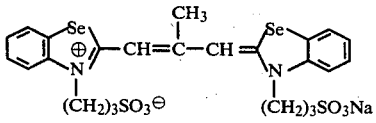
9.
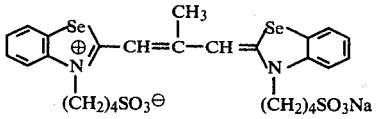
10.
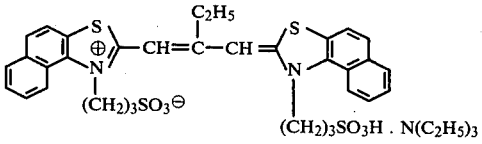
11.
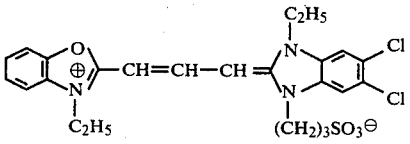
12.
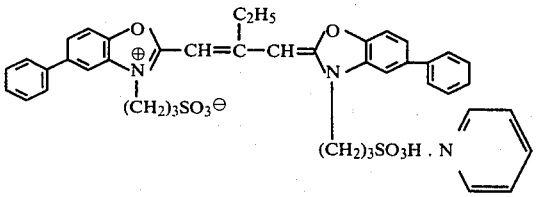
-continued
13.
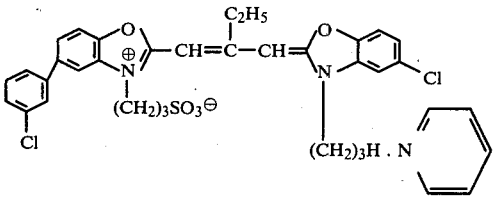
14.
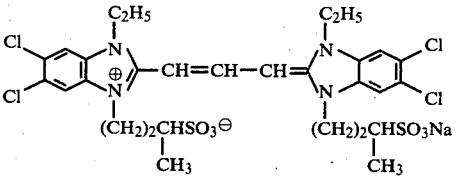
15.
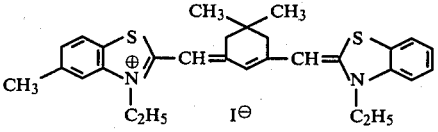
16.
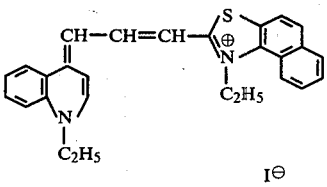
17.
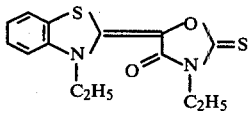
18.
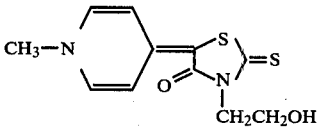
19.
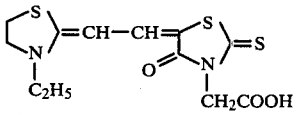
20.
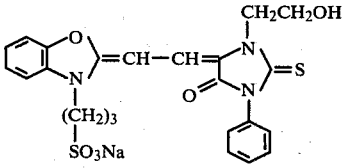
21.
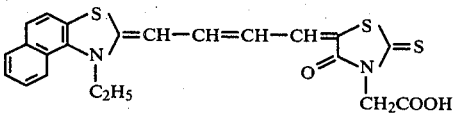
22.
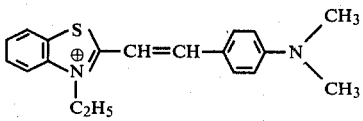
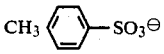

-continued
23.
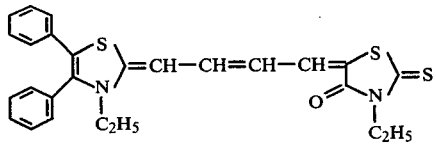
24.
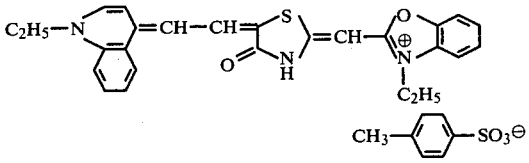
25.
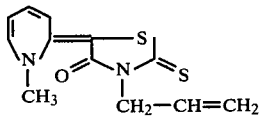
26.
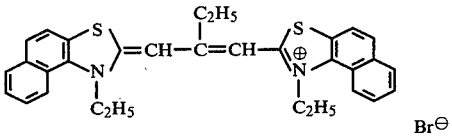
27.
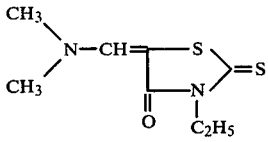
28.
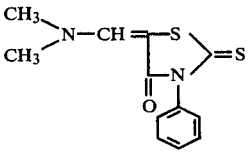
29.
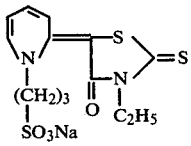
30.
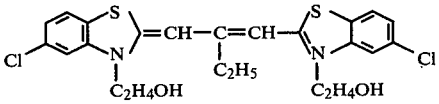
31.
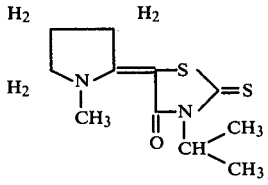
32.
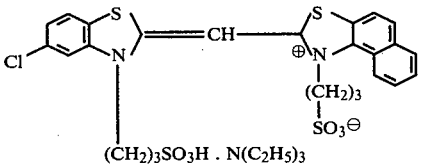
-continued
33.
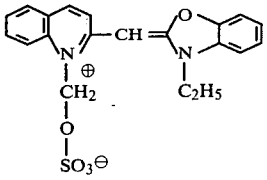
34.
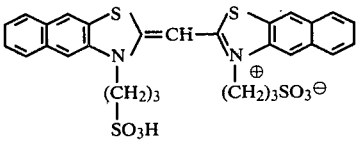
35.
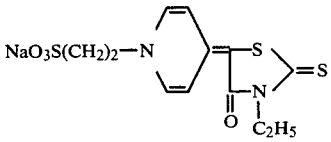
36.
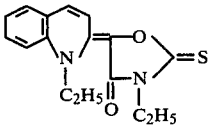
37.
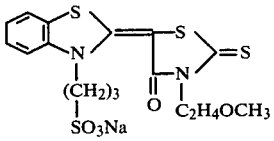
38.
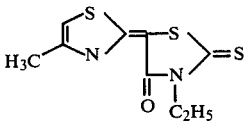
39.
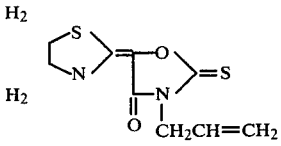
40.
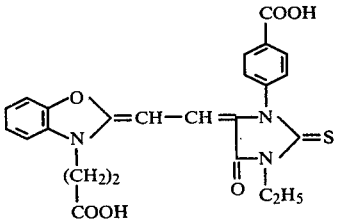
41.
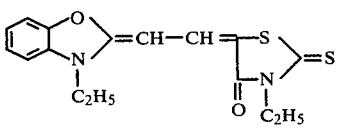
42.
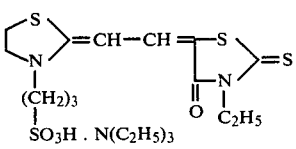

-continued
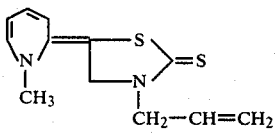
43.
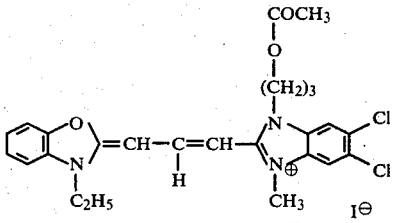
44.
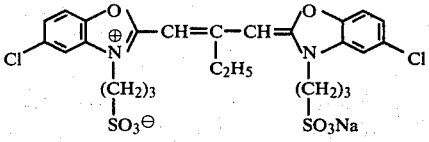
45.
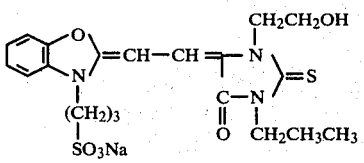
46.
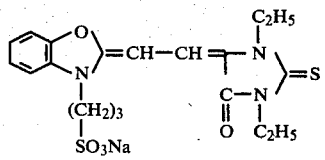
47.
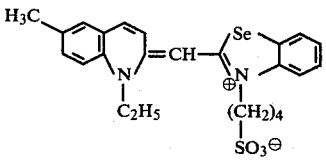
48.
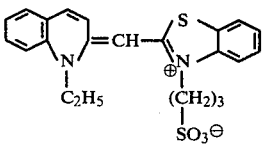
49.
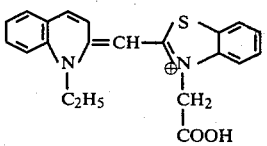
50.
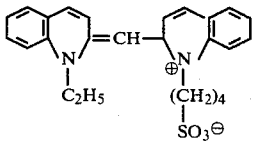
51.
-continued
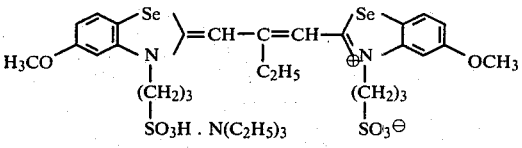
52.
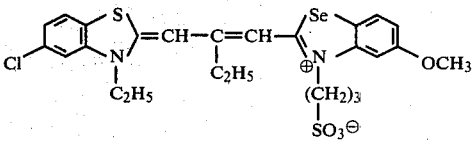
53.
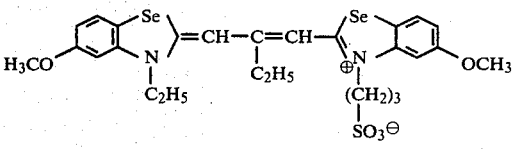
54.
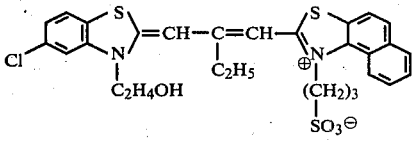
55.
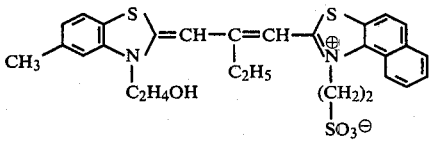
56.
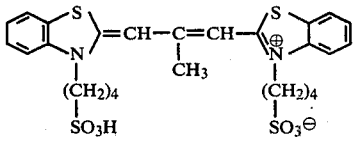
57.
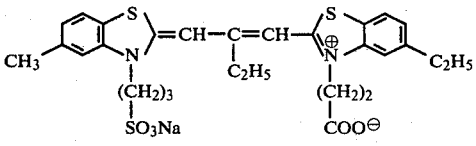
58.
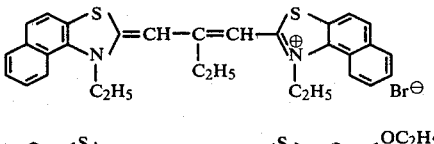
59.
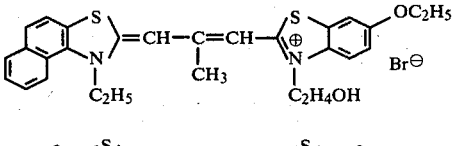
60.
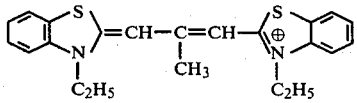
61.
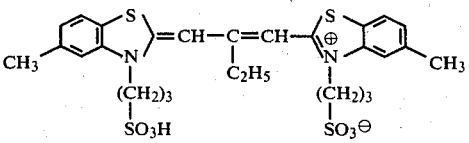
62.

-continued

63.

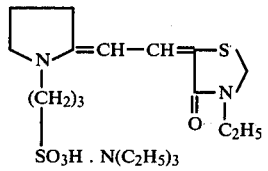

64.

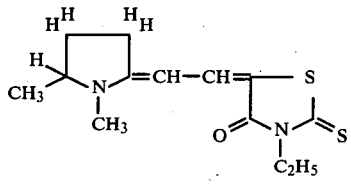

65.

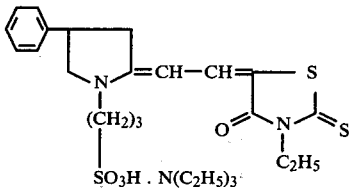

66.

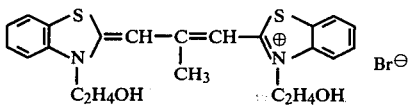

67.

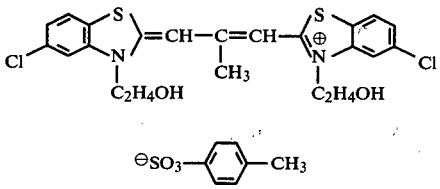

These compounds of this invention can readily be synthesized by the methods described in e.g. U.S. Pat. Nos. 2,213,995, 3,711,288, 2,503,776, 3,576,641, 2,945,763, 3,625,698, etc.

These sensitizing dyes according to this invention may be incorporated into a hydrophilic colloid containing the silver halide of this invention by dissolving them in water or an organic solvent, such as methanol and ethanol, which is miscible with water in any ratio and they can be used in alone or in a combination of two or more.

The incorporation of the sensitizing dyes into said hydrophilic colloid may be carried out any time during the preparation of the silver halide emulsion, but is generally preferred to be after the completion of the second ripening.

The sensitizing dye can be used in an amount of 10 mg to 1 g, preferably 30 to 300 mg, per one mole of silver halide.

The light-sensitive silver halide photographic material of this invention, in which the sensitizing dye is incorporated, can show not only an excellent stability during development but also can be sensitized in any preferred spectrum range.

As the silver halide employed for the light-sensitive silver halide photographic material of the invention, there can be included silver halide used for the conventional silver halide photographic materials, e.g. silver bromide, silver chlorobromide, silver iodobromide, silver chloroiodobromide or silver chloride and the like.

The average grain size of the silver halide in the invention is 0.05–1.5μ, preferably 0.1–0.8μ, and at least 75% grains of the total grains are within a range of 0.6–1.4, preferably 0.7–1.3 times the average grain size. Furthermore, the silver halide comprises silver chlorobromide or chloroiodobromide containing at least 50 mole % silver chloride. The silver halide of the invention having the above-mentioned average grain size and the distribution thereof may be prepared by any known method described, e.g. in U.S. Pat. Nos. 2,592,250, 3,276,877, 3,317,322, 2,222,264, 3,320,069 and 3,206,313 and in Journal of Photographic Science 12(5), 242–251 (1964). Silver halides prepared by other methods may also be employed in mixture.

According to the most preferred concrete embodiment of the invention, the silver halide of the invention is silver chloroiodobromide or chlorobromide having an average grain size of 0.25–0.5μ and at least 80% grains of the total grains being within a range of 0.7–1.3 times the average grain size.

The silver halide emulsion of the invention may be sensitized with various kinds of chemical sensitizers. As the sensitizer, there can be mentioned, for example, activated gelatin, sulfur sensitizers (e.g. sodium thiosulfate, aryl thiocarbamide, thiourea or aryl isocyanate, etc.), selenium sensitizers (e.g. N,N-dimethylserenourea or selenourea, etc.), reducing sensitizers (e.g. triethylenetetramine or stannic chloride, etc.) and various noble metal sensitizers represented by potassium chloroaurite, potassium auriothiocyanate, potassium chloroaurate, 2-aurosulfobenzothiazole methylchloride, ammonium chloropalladate, potassium chloroplatinate and sodium chloropalladite. The sensitizer may be employed alone, or mixed together. Ammonium thiocyanate may be auxiliarily employed when a gold sensitizer is employed.

The silver halide emulsion of the invention may preferably be stabilized with 5,6-trimethylene-7-hydroxy-s-triazolo(1,5-a)pyrimidine, 5,6-tetramethylene-7-hydroxy-s-triazolo(1,5-a)pyrimidine, 5-methyl-7-hydroxy-s-triazolo(1,5-a)pyrimidine, 7-hydroxy-s-triazolo(1,5-a)pyrimidine, 5-methyl-6-bromo-7-hydroxy-s-triazolo(1,5-a)pyrimidine, esters or salts of gallic acid (e.g. isoamyl gallate, dodecyl gallate, propyl gallate or sodium gallate), mercaptans (e.g. 1-phenyl-5-mercaptotetrazole or 2-mercaptobenzothiazole), benzotriazoles (e.g. 5-bromobenzotriazole or 4-methylbenzotriazole) and benzimidazoles (e.g. 6-nitrobenzimidazole). Such stabilizers are described in, e.g. U.S. Pat. Nos. 2,444,607, 2,716,062, 3,512,982 and 3,342,596, German Patent Publications Nos. 1,189,380, 2,058,626 2,118,411 and 2,149,789, Japanese Patent Publications Nos. 2825/1964, 4133/1968 and 4417/1972, Japanese Patent Application No. 77072/1970. Furthermore, the silver halide emulsion of the invention may contain a latent image stabilizer such as a sulfur-containing amino acid, or a gradation-adjusting agent such as a cadmium or rhodium salt, described in, e.g. German Patent Publications Nos. 2,217,153 and 2,217,895.

It has been known in, e.g. British Pat. No. 775,197 and U.S. Pat. No. 3,488,709, to employ a rhodium or cadmium salt to increase the contrast of silver halide emulsion. However, problems still remain when the rhodium salt is employed. For example, the use of rhodium salt tends to cause an unevenness of the product due to the minute amount of addition and the narrow allowable range thereof of the salt, and thus makes it difficult to produce stable photographic material. In case of the cadmium salt, it has to be added as little as possible from an ecological viewpoint, for it is washed out by film-processing and comes finally into the environment. The cadmium salts are known to prevent the metabolism and to be harmful to living tissues. Cadmium may be detected not only in air but also in the bodies of sea animals. As a result of interest in public health and in the maintenance of normal ecological balance in view of the toxicity of rare metals, including cadmium mentioned above, we have reached the invention relating to a novel method to obtain a light-sensitive material with sufficiently high contrast, without the use of such harmful metals when the above-mentioned silver halide, tetrazolium compound and sensitizing dye of the invention are incorporated into the hydrophilic colloidal layer.

The hydrophilic colloid advantageously employed in the invention is gelatin. As hydrophilic colloids other than gelatin, are mentioned, e.g. colloidal albumin, agar, gum arabic, arginic acid, hydrolyzed cellulose acetate, acrylamide, imidated polyamide, polyvinyl alcohol, hydrolized polyvinyl acetate, water-soluble polymer described in, e.g. British Pat. No. 523,661, German Patent Publications Nos. 2,255,711 and 2,046,682, U.S. Pat. No. 3,341,332, gelatin derivatives such as phenylcarbamyl-, acylated- or phthalated- gelatin described in, e.g. U.S. Pat. Nos. 2,614,928 and 2,525,753, or gelatin graft-polymerized with monomers having the ethylene group and being capable of polymerization, such as acrylic acid and the ester thereof, styrene, methacrylic acid and the ester thereof, described in, e.g. U.S. Pat. Nos. 2,548,520 and 2,831,767. Such hydrophilic colloids may also be applied to a layer containing no silver halide, e.g. an antihalation layer, a protective layer or a intermediate layer.

The light-sensitive silver halide material of the invention may be prepared by coating the above-mentioned layer containing the silver halide, the sensitizing dye and the tetrazolium compound of the invention on a suitable photographic support. As the representative supports employed in the invention are mentioned, e.g. a baryta paper, a polyethylene-coated paper, a synthetic polypropylene paper, a glass plate, a cellulose acetate or cellulose nitrate film, a polyester film such as a polyethylene terephthalate film, a polyamide film, a polypropylene film, a polycarbonate film, a polystyrene film and the like. The supports are optionally selected depending on the purpose for which the light-sensitive photographic material is used.

As mentioned above, the light-sensitive silver halide photographic material of the invention comprises at least one hydrophilic colloidal layer, coated on a support, containing a silver halide of the invention and a sensitizing dye and a tetrazolium compound.

It is preferable in the light-sensitive material of the invention that a protective layer having a suitable thickness is coated. The protective layer is advantageously a gelatin layer, the thickness of which is preferably 0.1–10$\mu$, more preferably 0.8–2.0$\mu$.

The hitherto known lith type light-sensitive silver halide photographic materials usually have a protective layer. In this invention, however, the protective layer plays an important role different from known ones.

The protective layer is, in general, coated for the purpose to protect the silver halide emulsion layer from incidental mechanical damage during production processes, e.g. cutting, winding or wrapping process, or during photographing and/or processing caused by contact of the light-sensitive material with other substance.

It has turned out that the protective layer of the invention not only protects the above-mentioned silver halide emulsion but also plays an important role for processing stability. That is, while the lith type light-sensitive material has to be able to form a very high contrast line- and dot-image, if a tetrazolium compound oxidizing a developing agent contained in the developing solution of the invention is added to the light-sensitive silver halide photographic material to obtain the above-mentioned high contrast silver image, the above-mentioned tetrazolium compound as an oxidizing agent has a large influence on the development during the progress thereof and consequently, the quality of the line- or dot-image obtained is largely influenced by the difference of e.g. a developing time, a temperature and an amount of the exposure.

It is not necessarily elucidated in the process of the invention why the presence of the protective layer may act effectively on the stability of the image quality and of the developing process. Presumably, the protective layer may have a function to control adequately the infiltration rate of a developing agent such as Metol, phenidone, etc. from the processing solution into the light-sensitive material, or the diffusion rate of the tetrazolium compound within the light-sensitive material or therefrom to the processing solution.

This effect is remarkable when the tetrazolium compound of the invention is employed. The effect is not so remarkable when other oxidizing agents than the tetrazolium compound, described in, e.g. Japanese Patent Application No. 94295/1975 are employed.

Various kinds of photographic additives may optionally be added to the above-mentioned hydrophilic colloid of the invention, as far as they do not impair the effect of the invention. As the additives, there can be used, e.g. a gelatin plasticizer, a hardening agent, a surface active agent, an image stabilizer, an ultraviolet absorber, an antistaining agent, a pH adjuster, an antioxidant, an antistatic agent, a viscosity-increasing agent, a granularity improving agent, a dye, a mordant, a brightening agent, a development regulator, a matting agent, and the like.

Among the additives mentioned above, the following may particularly and preferably be employed: viscosity-increasing agents and plasticizers, described in U.S. Pat. Nos. 2,960,404 and 3,767,410, Japanese Patent Publications Nos. 4939/1968 and 15462/1970, Japanese Patent Provisional Publication No. 63715/1973, German Patent Publication No. 1,904,604, Belgium Patents Nos. 762,833 and 558,143, e.g. a styrene/sodium maleate copolymer and dextran sulfate, etc.; hardening agents of an aldehyde, epoxy, ethyleneimine, active halogen, vinylsulfone, isocyanate, sulfonic acid ester, carbodiimide, mucochloric acid or acyloyls, etc.; image stabilizers, e.g. 6,6'-butylidenebis(2-t-butyl-4-methylphenol) and 4,4'-methylene-bis(2,6-di-t-butylphenol), etc.; ultraviolet absorbers, described in, e.g. Japanese Patent Publications Nos. 736/1973, 5496/1973, 41572/1973, 30492/1973 and 31255/1973, U.S. Pat. No. 3,253,921, British Pat. No. 1,309,349, particularly 2-(2'-hydroxy-5'-t-butylphenyl) benzotriazole, 2-(2'-hydroxy-3',5'-di-t-butylphenyl)benzotriazole, 2-(2'-hydroxy-3'-t-butyl-5'-butylphenyl)-5-chlorobenzotriazole and 2-(2'-hydroxy-3',5'-di-t-butylphenyl)-5-chlorobenzotriazole; surface active agents for coating acids, emulsifiers, infiltration-improving agents for processing solution, defoamers, or agents for controlling various physical properties of the light-sensitive material, described in, e.g. U.S. Pat. Nos. 3,026,202 and 3,514,293, British Pat. Nos. 548,532 and 1,216,389, Japanese Patent Publications Nos. 26580/1969, 17922/1968, 17926/1968, 13166/1968 and 20785/1973, French Pat. No. 202,588, Belgium Pat. No. 773,459, Japanese Patent Provisional Publication No. 101118/1973, including anionic, cationic, nonionic and amphoteric compounds; mordants described in, e.g. U.S. Pat. Nos. 2,113,381 and 2,548,564; antistaining agents described in, e.g. U.S. Pat. Nos. 2,360,210, 2,728,659, 2,732,300 and 3,700,453, particularly 2-methyl-5-hexadecylhydroquinone, 2-methyl-5-sec-octadecylhydroquinone and 2,5-di-t-octylhydroquinone, etc.; antistatic agents described in, e.g. U.S. Pat. Nos. 2,882,157 and 2,972,535, Japanese Patent Publications Nos. 24159/1971, 24159/1971, 39312/1971, 43809/1973, 4853/1974, 64/1974 and 8742/1972, Japanese Patent Provisional Publication Nos. 89979/1973, 20785/1973, 43130/1973, 90391/1973 and 33627/1972; matting agents described in, e.g. U.S. Pat. Nos. 2,992,101 and 2,956,884, British Pat. No. 1,221,980, French Pat. No. 1,395,544, Japanese Patent Publication No. 43125/1973, particularly silica gel having a grain size of 0.5–20$\mu$ and polymethylmethacrylate having a grain size of 0.5–20$\mu$; developing promoters, e.g. benzyl alcohol and a polyoxyethylene series compound which may be added in the processing bath.

In accordance with the process of the invention, there is obtained a high contrast silver image. The invention is therefore applicable to various fields wherein a high contrast black-and-white recording is required. The light-sensitive material of the invention is, for example, applied preferably to a printing- or micro-sensitive material. The process of the invention for forming a lith type photographic image has superior characteristics which no conventional process has yet reached.

Although the reasons why a silver image with high contrast can be obtained by the method of the invention have not necessarily been elucidated, it may be considered that the silver image with such high contrast can be obtained due to the fact that the developing agent permeating from the developing solution is locally oxidized by the tetrazolium compound and active chemical species are accumulated in a high concentration near the developed part. It may be presumed that the rate of the active chemical species inactivated by the simultaneous reaction with the sulfite ions existing in large amounts in the developing solution is low.

It is firstly because the supply of active chemical species is far more than the consumption of the same and secondly because it is considered that, when an inhibitor in a developing solution described in the specification of British Pat. No. 1,376,600, e.g., 5-nitroindazole, etc., is used, the coupling of sulfite ions and the active chemical species is prevented. Accordingly, it is presumed that, according to the invention, the active chemical species produced may develop the silver halide with high contrast by a mechanism extremely similar to that of the usual infectious development.

In the developing solution of the invention, however, the concentration of sulfite ions need not be lowered at all as in the case of conventional infectious developing solutions. It may be added to the developing solution in large amounts per 1 liter (e.g., above 50 g) so as to decrease remarkably or to prevent substantially the oxidation by air. According to the method of the invention, the largest defect in the conventional infectious developing solution has been overcome.

The developing solution of the invention contains substantially no hydroquinone developing agent. More concretely, the developing agent of the invention includes each of the organic or inorganic developing agents and developing aids (auxiliaries) except hydroquinone developing agents, as described in E. K. Mees and T. H. James, "The Theory of the Photographic Process", 3rd edition, p. 278–381 (1966), and the combinations thereof.

The developer used in this invention is a developer comprising a developing agent other than a hydroquinone developing agent.

As to the developing agents used in this invention, any compound (except hydroquinone developing agents) capable of reducing silver halides can be generally used and typical examples of the compound are following organic and inorganic compounds:

[Inorganic developing agents]

Fe(II), Co(II), Ti(III) and V (II) ions and complexes thereof, for example, EDTA-Fe(II) salt, $(C_2O_4)_2Fe(II)$ salt, $(C_6H_5O_7)_3Fe(II)$ salt and bis(1-hydroxy-3-methylcyclopentadienyl)Fe(II) salt, and copper complexes such as $Cu(NH_3)_2$—, dithionite such as $Na_2S_2O_4$, and organic substitution products of inorganic developing agents such as hydroxylaminehydrazine, phenylhydrazine, hydrazobenzene and phenylhydroxylamine.

[Organic developing agent]

The compounds represented by the following formula (A) are preferably used:

Formula (A)

$$R_1'—Z—R_2'$$

wherein Z is an arylene group including arylene and substituted arylene such as phenylene, naphtylene and phenylene or naphtylene substituted with the group consisting of hydroxyl, alkyl (such as methyl, ethyl, propyl) carboxyl, halogen (such as chlorine, bromine) acetamido, alkoxy (such as methoxy ethoxy), amino, hydroxybenzoyl, phenyl; $R_1'$ and $R_2'$ are individually hydroxyl or an

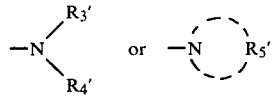

in which $R_3'$ and $R_4'$ each represent hydrogen hydroxyl, an alkyl group including alkyl and substituted alkyl such as methyl, ethyl, propyl, or alkyl substituted with the group consisting of alkoxy, aryloxy, hydroxyl, alkylacylamino, arylacylamino, alkylsulfphonamido, arylsulfphonamido, alkylcarbamoyl, arylcarbamoyl and carboxyl; $R_5'$ represents a non-metalic atomic group for forming 5- or 6-membered heterocyclic ring, the atomic group being such as morpholino, tetrahydrofurfuryl, piperidino.

In this Formula (A), both of $R_1'$ and $R_2'$ cannot simultaneously be hydroxyl when $R_1'$ and $R_2'$ are attached to said arylene group of Z in para-position relation.

More preferable are the sole use of Metol, the combination of Phenidone and Metol, the combination of p-aminophenol and catechol and the combination of Phenidone and p-aminophenol. But further various combinations thereof can afford good photographic images. The developing solution of the invention may desirably have a pH value of 8.5–12 preferably 9.5–11.0.

Characteristics inherent to the invention which can not be found in the process with a developing solution containing a hydroquinone developing solution, can be derived by using the above-mentioned developing agents and the combination of the same. The characteristics are as follows.

(1) A good photographic property can be obtained in a short development time.
(2) The toe part of the characteristic curve is reduced sharply and photographic properties of dot and line are excellent.
(3) $\gamma$-value in compliance with the purpose can be obtained by optional selection of the developing agent.
(4) Reducing power property is excellent since the developed silvers are fine grains.
(5) Since the amount of absorbent substances are small against developed silver, there is no remaining color when a reducing solution of ion chelate using no hypo-ferrocyan or of celium chelate is employed and reduction can smoothly be effected.
(6) The developability of shadow-dot part is the same as that of highlight-dot part (will be described hereinafter).
(7) Reliability of $\gamma$ upon development time is little.

Although there were many problems regarding the above-mentioned items when hydroquinones are used as a developing agent, a high contrast photographic image with a good quality can be obtained by the skillful combination of the light-sensitive silver halide photographic material of the invention and the developing agent of the invention.

It has hitherto been known that a ultra high contrast black-and-white developing solution usually contains a hydroquinone developing agent, particularly hydroquinone. Particularly, hydroquinones have been indispensable as a developing agent in order to cause infectious development (lith development). According to the invention, it may be said that a stable ultra high contrast development system which would replace conventional infectious development system has been completed.

The effect of the invention is not impaired even by using a preservative such as, for example, sodium sulfite, potassium sulfite, ammonium sulfite, etc., in the developing solution employed for the invention, which fact may be mentioned as one of the characteristics of the invention. The sulfite may desirably be contained in an amount of $10^{-2}$–$10^{-1}$ mole/l. Hydroxylamine or a hydrazide compound may as well be used as a preservative. It is optional to adjust the pH value and bufferize the medium with a caustic alkali, an alkali carbonate, an amine, etc., as used in the general black-and-white developing solution, and to add an inorganic development inhibitor such as potassium bromide, etc., and an organic development inhibitor such as benztriazole etc., a heavy-metal sequestering agent (a water-softening agent) such as ethylenediaminetetraacetic acid, etc., a hardening agent such as formalin, glyoxal, glutaraldehyde, etc., a surfactant such as sodium dodecylbenzenesulfonate, a development promoting agent such as polyethylene glycol oleate, etc., a photographic coupler such as open-chain methylene type yellow coupler, 5-pyrazolone type mazenta coupler, phenol, $\alpha$-naphthol type cyan, etc., and so on.

In the invention, "to treat with a developing solution containig no hydroquinone developing agent" means "to develop, after image-wise exposure of the light-sensitive silver halide photographic material of the invention, in a developing solution which fulfill the conditions mentioned above", and various embodiments may be included. For instance, development temperature may preferably be below 50° C., especially around 30° C. Development time is generally within 5 minutes. Development time within 3 minutes sometimes brings about good results. It is optional to adopt a treatment step after development, e.g., water washing, stopping, stabilization and fixing, and to adopt further, as occasion demands, such a step as pre-hardening, neutralization, etc., and these steps may be omitted according to circumstances. Further, these treatments may be carried out by so-called development-by-hand such as dish development, frame development, etc., or by machine development such as roller development, hanger development, etc. According to a preferred embodiment of the invention, the processing solution in dish development was stable for 20 times as long a period of time compared with a conventional lith developing solution. In cases where the hitherto known special developing solution (a developing solution containing extremely small amount of sulfite, namely, a lith type developing solution) was used to improve the dot quality of the lith type light-sensitive material, it became unusable in only several hours. On the contrary to that, the processing solution according to a preferred embodiment of the invention could stably be used after not less than one month, the dot quality was the same as that obtained by treatment with a new solution. Moreover, even if there are added additives such as a hardening agent, a toe-part-reducer, etc., which have frequently been used in a conventional high contrast developing solution, the photographic properties are not affected.

As may be understood clearly from the above description, the invention relates to a novel light-sensitive silver halide photographic material which comprises the combination of a tetrazolium salt and a silver halide of the invention having narrow grain size distribution and which can afford an excellent dot- or line-image without any infectious developing solutions by treating said light-sensitive material with a developing solution not containing a hydroquinone developing agent, and to a method of processing the same.

According to the invention, an excellent silver image with high contrast can be obtained even when a diffusible tetrazolium compound is used, and a non-diffusible tetrazolium compound may possibly afford more excellent dot-image than the method described in the specification of Japanese Patent Application No. 94295/1975.

The invention is further concretely explained by the following Examples, which by no means restrict the scope of the invention and various many modified embodiments may be possible

EXAMPLE 1

An emulsion containing silver halides consisting of 90 mole % of silver chloride, 9 mole % of silver bromide and 1 mole % of silver iodide, which silver halides have an average grain size of 0.22$\mu$, 75% of the grains being within a range of 0.13–0.30$\mu$, was prepared. After the emulsion was subjected to chemical ripening with a gold sensitizer and a sulfur sensitizer, the following compounds were added to the emulsion in the indicated amount per 1 mole of silver in the emulsion.

| | |
|---|---|
| 4-Hydroxy-6-methyl-1,3,3a,7-tetrazaindene | 0.83 g |

-continued

| | |
|---|---|
| Spirobis(3,3-dimethyl-5,6-dihydroxyindane) | 0.45 g |
| Polyethylene glycol oleate (molecular weight: 1540) | 0.30 g |
| A tetrazolium compound | 2.5 g |
| A pair-ion compound of the tetrazolium compound | equimolar amount to the tetrazolium compound |
| Sensitizing dye | 150 mg |
| Saponin | 3 g |
| Mucochloric acid | 0.7 g |

The thus prepared emulsion was coated on a polyethylene terephthalate support so that 45 mg/100 $cm^2$ of silver and 18 mg/100 $cm^2$ of gelatin might be incorporated in the coated emulsion. Further, on the emulsion layer was applied a gelatin layer containing 12 mg/100 $cm^2$ of gelatin to prepare each samples 1 to 7 of light-sensitive materials. These samples are shown in Table 1.

TABLE 1

| Sample | Tetrazolium compound: The salt of tetrazolium | Tetrazolium compound: Anion moiety of the tetrazolium compound | Sensitizing dye |
|---|---|---|---|
| 1 | 2,3,5-Triphenyl-2H-tetrazolium chloride | none | 10 |
| 2 | 2,3,5-Triphenyl-2H-tetrazolium chloride | DES (Note 1) | 10 |
| 3 | 2,3-Diphenyl-5-nitrophenyl-2H-tetrazolium chloride | DES | 17 |
| 4 | 2-Chlorophenyl-3,5-diphenyl-2H-tetrazolium chloride | DES | 18 |
| 5 | 2,3-Dichlorophenyl-5-nitrophenyl-2H-tetrazolium chloride | DIPN (Note 2) | 20 |
| 6 | 2,3,5-Triphenyl-2H-tetrazolium chloride | DES | none |
| 7 | none | none | none |

Note 1: DES = Diethylhexylsuccinatesulfonic acid
Note 2: DIPN = Diisopropylnaphthalenesulfonic acid These samples were exposed to light with a pulsed xenon lamp through a gray contact screen and an optical wedge, and processed with developing solution A or B having the following compositions.

| | |
|---|---|
| [Developing solution A] | |
| 1-Phenyl-3-pyrazolidone | 0.5 g |
| Anhydrous sodium sulfite | 60 g |
| Sodium ascorbate | 15.0 g |
| Sodium carbonate monohydrate | 54 g |
| Potassium bromide | 2.5 g |
| 5-Nitrobenztriazole | 0.2 g |
| 1-Phenyl-5-mercaptotetrazole | 10 mg |
| Water | to make 1 liter (pH = 10.20) |
| [Developing solution B] | |
| Metol | 8 g |
| Anhydrous sodium sulfite | 60 g |
| Sodium carbonate monohydrate | 54 g |
| Potassium bromide | 2.5 g |
| 5-Nitrobenzimidazole | 0.2 g |
| Water | to make 1 liter (pH = 10.20) |

The results are shown in Table 2.

TABLE 2

| Developing solution | Sample | Development time (minute) | Specific sensitivity | Fog | Dot quality |
|---|---|---|---|---|---|
| A | 1 | 0.5 | 50 | 0.04 | 3.0 |
| | | 1 | 75 | 0.04 | 3.0 |
| | | 1.5 | 100 | 0.04 | 3.5 |
| | | 2 | 120 | 0.04 | 3.0 |
| | 2 | 0.5 | 50 | 0.04 | 3.5 |
| | | 1 | 85 | 0.04 | 3.5 |
| | | 1.5 | 100 | 0.04 | 4.0 |
| | | 2 | 110 | 0.04 | 4.0 |
| | 3 | 0.5 | 50 | 0.04 | 3.0 |
| | | 1 | 85 | 0.04 | 3.5 |
| | | 1.5 | 100 | 0.04 | 3.5 |
| | | 2 | 115 | 0.04 | 3.0 |
| | 4 | 0.5 | 50 | 0.04 | 3.0 |
| | | 1 | 90 | 0.04 | 3.5 |
| | | 1.5 | 100 | 0.04 | 3.5 |
| | | 2 | 105 | 0.04 | 3.5 |
| | 5 | 0.5 | 55 | 0.04 | 3.5 |
| | | 1 | 90 | 0.04 | 3.5 |
| | | 1.5 | 100 | 0.04 | 4.0 |
| | | 2 | 105 | 0.04 | 4.5 |
| | 6 | 0.5 | 20 | 0.04 | 3.0 |
| | | 1 | 60 | 0.04 | 4.0 |
| | | 1.5 | 100 | 0.06 | 3.5 |
| | | 2 | 150 | 0.10 | 3.0 |
| | 7 | 0.5 | 5 | 0.06 | 1 |
| | | 1 | 40 | 0.10 | 1 |
| | | 1.5 | 100 | 0.23 | 1 |
| | | 2 | 110 | 0.32 | 1 |
| B | 1 | 0.5 | 60 | 0.04 | 3.0 |
| | | 1 | 80 | 0.04 | 3.0 |
| | | 1.5 | 100 | 0.04 | 3.5 |
| | | 2 | 115 | 0.04 | 3.0 |
| | 2 | 0.5 | 70 | 0.04 | 3.5 |
| | | 1 | 95 | 0.04 | 3.5 |
| | | 1.5 | 100 | 0.04 | 4.0 |
| | | 2 | 110 | 0.04 | 4.5 |
| B | 3 | 0.5 | 65 | 0.04 | 3.0 |
| | | 1 | 85 | 0.04 | 3.5 |
| | | 1.5 | 100 | 0.04 | 4.0 |
| | | 2 | 115 | 0.04 | 3.5 |
| | 4 | 0.5 | 60 | 0.04 | 3.0 |
| | | 1 | 90 | 0.04 | 3.5 |
| | | 1.5 | 100 | 0.04 | 3.5 |
| | | 2 | 110 | 0.04 | 3.0 |
| | 5 | 0.5 | 70 | 0.04 | 3.5 |
| | | 1 | 90 | 0.04 | 3.5 |
| | | 1.5 | 100 | 0.04 | 4.0 |
| | | 2 | 105 | 0.04 | 4.5 |
| | 6 | 0.5 | 20 | 0.04 | 3.0 |
| | | 1 | 65 | 0.05 | 4.5 |
| | | 1.5 | 100 | 0.08 | 3.5 |
| | | 2 | 150 | 0.12 | 3.0 |
| | 7 | 0.5 | 5 | 0.05 | 1 |
| | | 1 | 40 | 0.08 | 1 |
| | | 1.5 | 100 | 0.18 | 1 |
| | | 2 | 110 | 0.25 | 1 |

The "dot-quality" shown in Table 2 is an evaluated value of a microscopic quality of an image which is obtained through a contact screen. A dot-image (halftone image) usually forms a part called "shadow dot part" and a part called "hilight dot part". In the intermediate part, dots having various sizes stand in oderly line. "Dot quality" as shown in Table 2 mentioned above is an evaluated value in the part called "50% dot" (that is, in which ½ is clear and another ½ is a developed density), which value is expressed in a progressive scale of 1 to 5. The value "5" denotes excellent results and "1" extremely poor results. In general, when the value is more than "3", it can practically be employed.

A specific value was shown as a relative value which was obtained by assuming the value of each sample at 1.5 minutes as "100".

As shown in Table 2 mentioned above, the light-sensitive material of the invention can afford a predetermined dot quality and sensitivity which are stable against the variation of the time for development conducted with various developing solutions not containing hydroquinone developing agent. Further, the light-sensitive material of the invention forms little fog, affords increased sensitivity and desired sensitivity, and thus a great advantage can be obtained.

EXAMPLE 2

Silver iodobromide (consisting of 98.5 mole % of AgBr and 1.5 mole % of AgI) having an average grain size of 0.53μ, 80% of the total grains being within a range of 0.32–0.74μ, was sensitized with gold and sulfur sensitizers in the presence of a thiocyanate. The following compounds were further added thereto in the indicated amounts per 1 mole of silver.

| | |
|---|---|
| 4-Hydroxy-6-methyl-1,3,3a,7-tetrazaindene | 1.0 g |
| A latex comprising a copolymer of vinylidene chloride and vinyl acetate | 11.0 g |
| A tetrazolium compound | 6.0 g |
| A pair-ion compound of the tetrazolium compound | equimolar amount to the tetrazolium compound |
| Sensitizing dye | 150 mg |
| Formalin (calculated based on formaldehyde) | 0.25 g |
| Saponin | 3 g |

The thus prepared emulsion was coated on a polyethylene terephthalate support so that the coat might contain 40 mg/100 cm² of silver and 22 mg/100 cm² of gelatin, and 12 mg/100 cm² of gelatin was further coated thereon to prepare samples 8 to 11. These samples are shown in Table 3.

TABLE 3

| Sample | Tetrazolium compound: The salt of tetrazolium compound | Tetrazolium compound: Anion moeity of tetrazolium compound | Sensitizing dye |
|---|---|---|---|
| 8 | 2,3,5-Triphenyl-2H-tetrazolium chloride | none | none |
| 9 | 2,3,5-Triphenyl-2H-tetrazolium chloride | none | 10 |
| 10 | 2,3,5-Triphenyl-2H-tetrazolium chloride | DES | none |
| 11 | 2,3,5-Triphenyl-2H-tetrazolium chloride | DES | 10 |

The samples mentioned above were exposed to light with a pulsed xenon lamp ($10^{-4}$ second) through a gray contact screen and an optical wedge, and processed with the following developing solution C at 30° C.

| [Developing solution C] | |
|---|---|
| 1-Phenyl-3-pyrazolidone | 0.3 g |
| Metol | 6 g |
| Anhydrous sodium sulfite | 50 g |
| Sodium carbonate monohydrate | 30 g |
| Potassium bromide | 2.5 g |
| 5-Nitroindazole | 0.1 g |
| Water | to make 1 liter (pH = 10.20) |

The results are shown in Table 4. A specific sensitivity was expressed as a relative value, when the sensitivity of each samples at 1 minute or 1.5 minutes was referred as to 100.

TABLE 4

| Sample | Development time (minute) | Specific sensitivity | γ |
|---|---|---|---|
| 8 | 1.0 | 100 | 9 |
| | 2.0 | 250 | 4 |
| 9 | 1.0 | 100 | 11 |
| | 2.0 | 150 | 7 |
| 10 | 1.5 | 100 | 20 |
| | 2.5 | 210 | 12 |
| 11 | 1.5 | 100 | 20 |
| | 2.5 | 125 | 18 |

It may also be understood from Example 2 that the light-sensitive material of the invention shows a remarkable stability against the variation of development time.

What is claimed is:

1. A method of processing a light-sensitive silver halide black and white photographic material to obtain a high contrast black and white silver image, said material comprising a support containing a silver halide emulsion layer containing silver halide grains having an average grain size of 0.25 to 0.5μ, at least 80% of said silver halide grains being of a grain size which falls within the range of 0.7 times said average grain size to 1.3 times said average grain size, said silver halide comprising (i) silver chlorobromide or silver chloroiodobromide, and (ii) at least 50 mole % of silver chloride, and a sensitizing dye, and also contains a tetrazolium compound selected from the group consisting of the compounds having the following general formulas I, II or III:

I

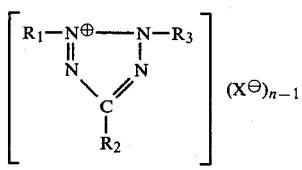

II

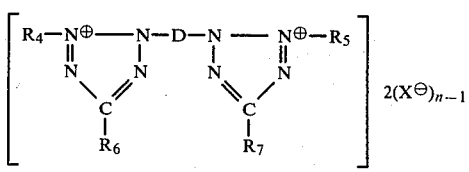

III

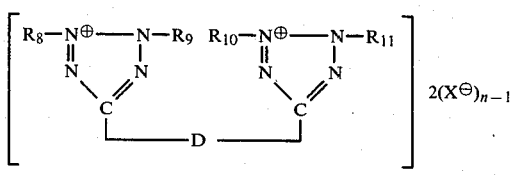

wherein $R_1$, $R_3$, $R_4$, $R_5$, $R_8$, $R_9$, $R_{10}$ and $R_{11}$ each represent an alkyl, alkenyl, aryl or heterocyclic group; $R_2$, $R_6$ and $R_7$ each represent allyl, phenyl, naphthyl, heterocyclic, alkyl or amino group, carboxyl, an alkoxycarbonyl group, mercapto, nitro or hydrogen; D represents an arylene group; E represents an alkylene, arylene or aralkylene group; $X^{\ominus}$ is an anion; and n is 1 or 2, provided that the compound forms an intramolecular salt when n is 1, comprising exposing said photographic material to an image and to light, and then developing said exposed photographic material in a developing solution which does not contain hydroquinone selected from the group consisting of Metol, phenidone and Metol, p-aminophenol and catechol, and phenidone and p-aminophenol, to form said high contrast black and white silver image.

2. A method according to claim 1 wherein said silver halide emulsion layer contains at least a sensitizing dye selected from the group consisting of the compounds having the general formulae [IV] to [X]:

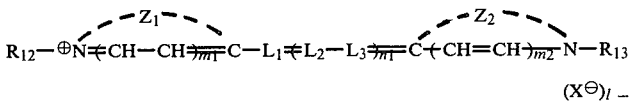

[IV]

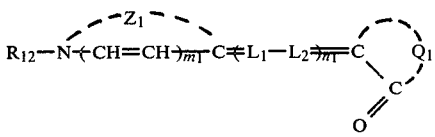

[V]

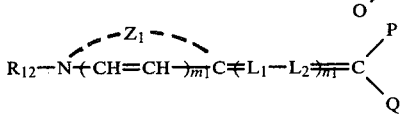

[VI]

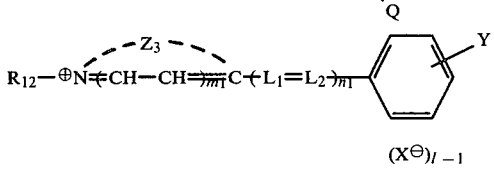

[VII]

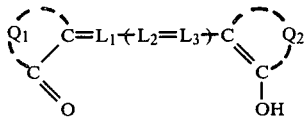

[VIII]

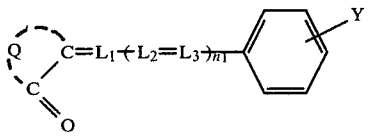

[IX]

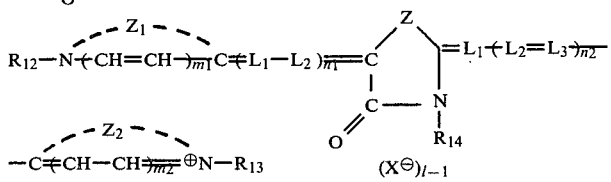

[X]

wherein $R_{12}$, $R_{13}$ and $R_{14}$ each represent a group selected from an alkyl group, a substituted alkyl group, an aryl group, and a substituted aryl group; $L_1$, $L_2$ and $L_3$ each represent a methynyl group or a substituted methynyl group; $Z_1$, $Z_2$ and $Z_3$ each represent an atom or atomic group necessary for forming a 5 to 6 membered heterocyclic ring; P and Q each represent cyano, —$COOR_{15}$, —$COR_{15}$ or —$SO_2R_{15}$ in which $R_{15}$ represents an alkyl group; $Q_1$ and $Q_2$ each represent an atomic group necessary for forming a thiooxazolone ring, a pyrazolone ring, an oxyindole ring, a barbituric acid, a 2-thiobarbituric acid, a 2,4-oxazolidinedione ring, a 2,4-thiazolidinedione ring, a 2,4-imidazolidinedione ring, a 2-thio-2,4-oxazolidinedion ring, a 2-thio-2,4-thiazolidinedione ring, a 2-thio-2,4-selenazolidinedione ring, a 2-thio-2,5-thiazolidinedione ring, a 2-thio-hydantoine ring, a 4-oxazolidinone ring, a 4-thiazolinone ring or a 4-imidazoline ring; Y represents a hydrogen atom, an amino group, an alkylamino group, a dialkylamino group and a halogen atom.

3. A method according to claim 1 wherein the tetrazolium compound is present in the silver halide emulsion layer.

4. A method according to claim 1 wherein the photographic material further comprises a hydrophilic colloidal layer adjacent to the silver halide emulsion layer, the compound being present in the hydrophilic colloidal layer.

5. A method according to claim 1 wherein the cation moiety of the tetrazolium compound is selected from the group consisting of the following:

(1) 2,3,5-Triphenyl-2H-tetrazolium
(2) 2,3,5-Tri(p-carboxyethylphenyl)-2H-tetrazolium
(3) 2-(Benzothiazol-2-yl)-3-phenyl-5-(o-chlorophenyl)-2H-tetrazolium
(4) 2,3-Diphenyl-2H-tetrazolium
(5) 2,3-Diphenyl-5-methyl-2H-tetrazolium
(6)3-(p-Hydroxyphenyl)-5-methyl-2-phenyl-2H-tetrazolium (7) 2,3-Diphenyl-5-ethyl-2H-tetrazolium (8) 2,3-Diphenyl-5-n-hexyl-2H-tetrazolium
(9) 5-Cyano-2,3-diphenyl-2H-tetrazolium
(10) 2-(Benzothiazol-2-yl)-5-phenyl-3-(4-tolyl)-2H-tetrazolium
(11) 2-(Benzothiazol-2-yl)-5-(4-chlorophenyl)-3-4-(nitrophenyl)-2H-tetrazolium
(12) 5-Ethoxycarbonyl-2,3-di(3-nitrophenyl)-2H-tetrazolium
(13) 5-Acetyl-2,3-di(p-ethoxyphenyl)-2H-tetrazolium
(14) 2,5-Diphenyl-3-(p-tolyl)-2H-tetrazolium
(15) 2,5-Diphenyl-3-(p-iodophenyl)-2H-tetrazolium
(16) 2,3-Diphenyl-5-(p-diphenyl)-2H-tetrazolium
(17) 5-(p-Bromophenyl)-2-phenyl-3-(2,4,6-trichlorophenyl)-2H-tetrazolium
(18) 3-(p-Hydroxyphenyl)-5-(p-nitrophenyl)-2-phenyl-2H-tetrazolium
(19) 5-(3,4-Dimethoxyphenyl)-3-(2-ethoxyphenyl)-2-(4-methoxyphenyl)-2H-tetrazolium
(20) 5-(4-Cyanophenyl)-2,3-diphenyl-2H-tetrazolium
(21) 3-(p-Acetamidophenyl)-2,5-diphenyl-2H-tetrazolium
(22) 5-Acetyl-2,3-diphenyl-2H-tetrazolium
(23) 5-(Fur-2-yl)-2,3-diphenyl-2H-tetrazolium
(24) 5-(Thien-2-yl)-2,3-diphenyl-2H-tetrazolium
(25) 2,3-Diphenyl-5-(pyrid-4-yl)-2H-tetrazolium
(26) 2,3-Diphenyl-5-(quinol-2-yl)-2H-tetrazolium
(27) 2,3-Diphenyl-5-(benzoxazol-2-yl)-2H-tetrazolium
(28) 2,3-Diphenyl-5-nitro-2H-tetrazolium
(29) 2,2',3,3'-Tetraphenyl-5,5'-1,4-butylene-di(2H-tetrazolium)
(30) 2,2',3,3'-Tetraphenyl-5,5'-P-phenylene-di(2H-tetrazolium)
(31) 2-(4,5-Dimethylthiazol-2-yl)-3,5-diphenyl-2H-tetrazolium
(32) 3,5-Diphenyl-2-(triazin-2-yl)-2H-tetrazolium
(33) 2-(Benzothiazol-2-yl)-3-(4-methoxyphenyl)-5-phenyl-2H-tetrazolium
(34) 2-p-Iodophenyl-3-nitrophenyl-5-phenyl-2H-tetrazolium.

6. A method according to claim 1 wherein the light-sensitive silver halide photographic material further comprises a protective layer having a thickness of 0.1 to 10μ.

7. A method according to claim 1 wherein the tetrazolium compound is a compound obtained from 2,3,5-triphenyl-aH-tetrazolium and diisopropylnaphthalenedisulfonic acid.

8. A method according to claim 1 wherein the tetrazolium compound is a compound obtained from 2,3,5-triphenyl-aPh-tetrazolium and diethylhexylsuccinate-sulfonic acid.

9. A method according to claim 1 wherein the developing solution contains a sulfite in an amount of more than 10 g per liter.

10. A method according to claim 1 wherein the developing solution has a pH value of 8.5 to 12.

* * * * *

UNITED STATES PATENT AND TRADEMARK OFFICE

CERTIFICATE OF CORRECTION

PATENT NO. : 4,268,620

DATED : May 19, 1981

INVENTOR(S) : TATESHI IYTAKA et al

It is certified that error appears in the above—identified patent and that said Letters Patent is hereby corrected as shown below:

Column 5, last line: "[IV]" should be --[VI]--.

Column 7, line 53: rewrite "chooride" as --chloride--.

Column 11, line 53: before "6-sul-" insert --5-hydroxybenzothiazole, 5-carboxyethylbenzothiazole,--.

Column 28, line 56: rewrite "oderly" as --orderly--.

Column 30, lines 60-65 (Claim 1): rewrite formula III as follows:

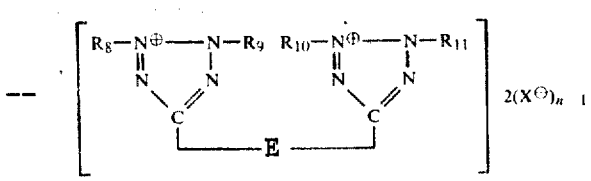

III

--.

Signed and Sealed this

Thirteenth Day of April 1982

[SEAL]

Attest:

GERALD J. MOSSINGHOFF

Attesting Officer

Commissioner of Patents and Trademarks